US006238238B1

(12) United States Patent
Hwang et al.

(10) Patent No.: US 6,238,238 B1
(45) Date of Patent: May 29, 2001

(54) ELECTRICAL CONNECTOR WITH REINFORCED ACTUATOR

(75) Inventors: Jenq-Yih Hwang, Irvine; Dennis B. Jones, Orange, both of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/659,865

(22) Filed: Sep. 12, 2000

(51) Int. Cl.[7] ..... H01R 9/07
(52) U.S. Cl. ..... 439/495; 439/496
(58) Field of Search ..... 439/260, 262, 439/263, 329, 492, 493, 495, 496, 499, 677, 680

(56) References Cited

U.S. PATENT DOCUMENTS 5,308,262 * 5/1994 Chishima ..... 439/495
5,370,552 * 12/1994 Chishima et al. ..... 439/495
5,397,247 * 3/1995 Aoki et al. ..... 439/496
5,688,143 * 11/1997 McHugh et al. ..... 439/495
5,934,932 * 8/1999 Ito ..... 439/495
6,089,904 * 7/2000 Wu ..... 439/495
6,159,038 * 12/2000 Wu ..... 439/495

* cited by examiner

*Primary Examiner*—Lincoln Donovan
*Assistant Examiner*—Thanh-Tâm Lê
(74) *Attorney, Agent, or Firm*—Wei Te Chung

(57) ABSTRACT

An electrical connector (10) for engaging with a flexible printed circuit (FPC) comprises an insulative housing (20) defining a central slot (22) therein for insertion of the FPC, a plurality of terminals (30) received within the central slot, and an actuator (40). The insulative housing forms a T-shaped securing portion (26) thereon. The actuator includes a base (42), and an inserting beam (44) and a reinforcing beam (46) respectively depending from the base. The inserting beam and the reinforcing beam are parallel to each other. The actuator defines a T-shaped securing channel (46*a*), for engaging with the T-shaped securing portion of the housing. The actuator further forms two V-shaped ribs (48) between the base and the reinforcing beam, for reinforcing the mechanical strength of the actuator. When the actuator is inserted into the central slot of the housing, the inserting beam firmly pushes the pre-inserted the FPC against the terminals in the central slot of the housing.

13 Claims, 7 Drawing Sheets

ELECTRICAL CONNECTOR WITH REINFORCED ACTUATOR

FIELD OF THE INVENTION

The present invention relates to an electrical connector, and particularly to a flexible printed circuit (FPC) electrical connector with a reinforced actuator.

BACKGROUND OF THE INVENTION

An FPC electrical connector usually has an actuator to facilitate electrical contact of the FPC with terminals secured within the housing of the electrical connector. However, long electrical connectors require correspondingly long actuators. A long actuator is prone to warp when it is inserted into or removed from an electrical connector.

Hence, an improved actuator for a long electrical connector is required to overcome the disadvantages of the prior art.

BRIEF SUMMARY OF THE INVENTION

An object of the present invention is to provide an FPC electrical connector having a reinforced actuator which does not warp when inserted into a housing of the connector, thus ensuring good electrical contact between an FPC and the connector.

Another object of the present invention is to provide an FPC electrical connector having a reinforced actuator which can be conveniently inserted into and withdrawn from the electrical connector.

To fulfill the above-mentioned objects, an FPC electrical connector in accordance with the present invention comprises an insulative housing defining a central slot therein for insertion of an FPC, a plurality of terminals received within the central slot, and an actuator. The insulative housing forms a T-shaped securing portion on an outer surface of a first wall thereof. The actuator includes a base and an inserting beam depending perpendicularly from the base. The actuator also has a reinforcing beam depending perpendicularly therefrom. The reinforcing beam is parallel to the inserting beam. The actuator defines a T-shaped securing channel on an outer surface thereof, for retaining the T-shaped securing portion of the housing. The actuator further forms two V-shaped ribs between the reinforcing beam and the base, for mechanically strengthening the actuator. The FPC and the actuator are inserted into the central slot, whereby the inserting beam firmly pushes the FPC against the terminals in the slot.

Other objects, advantages and novel features of the invention will become more apparent from the following detailed description of the present embodiment when taken in conjunction with the accompanying drawings.

DETAILED DESCRIPTION OF THE INVENTION

Figure 1:
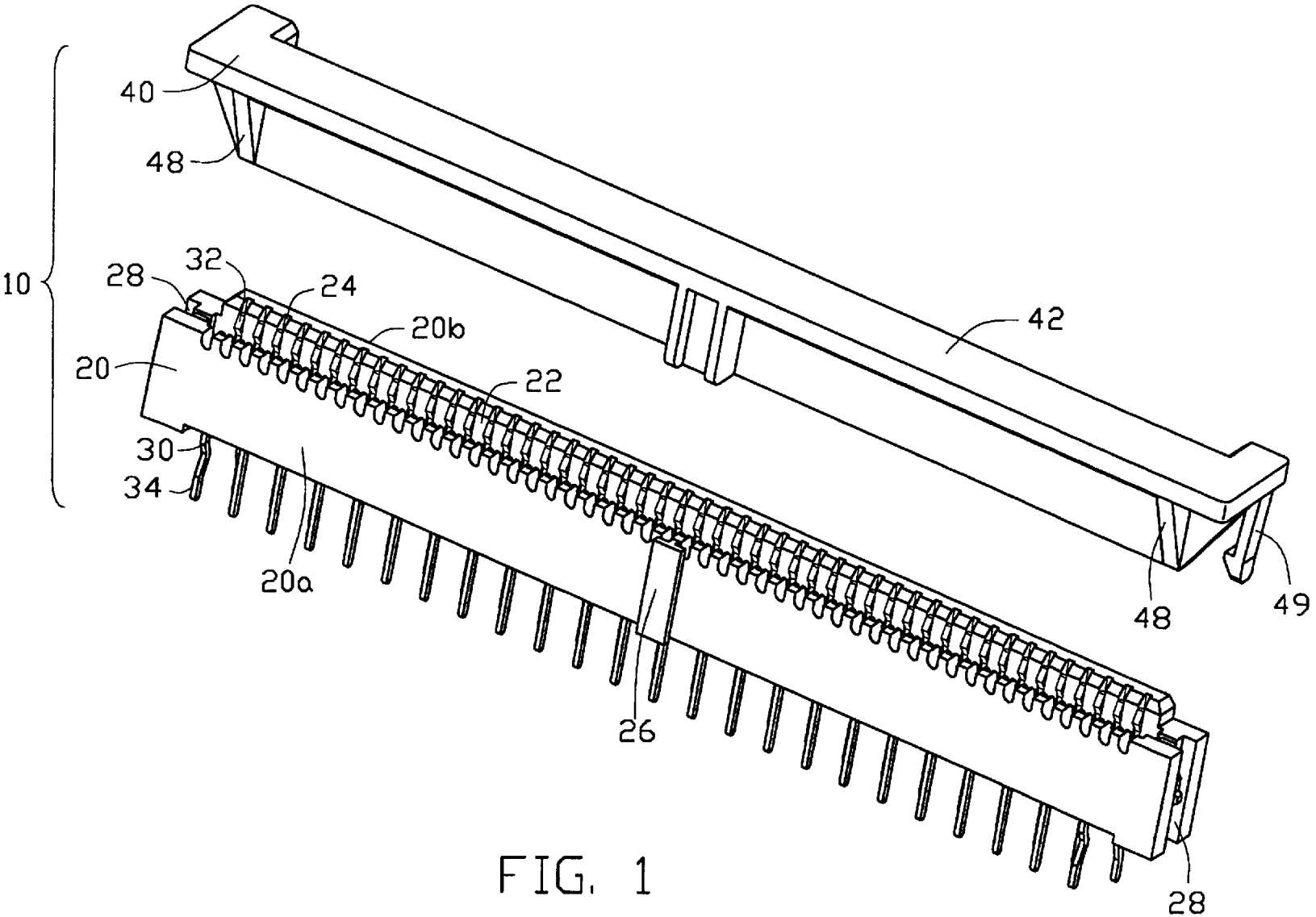
FIG. 1 is an exploded view of an electrical connector of the present invention, wherein terminals have been assembled within an insulative housing.
Figure 2:
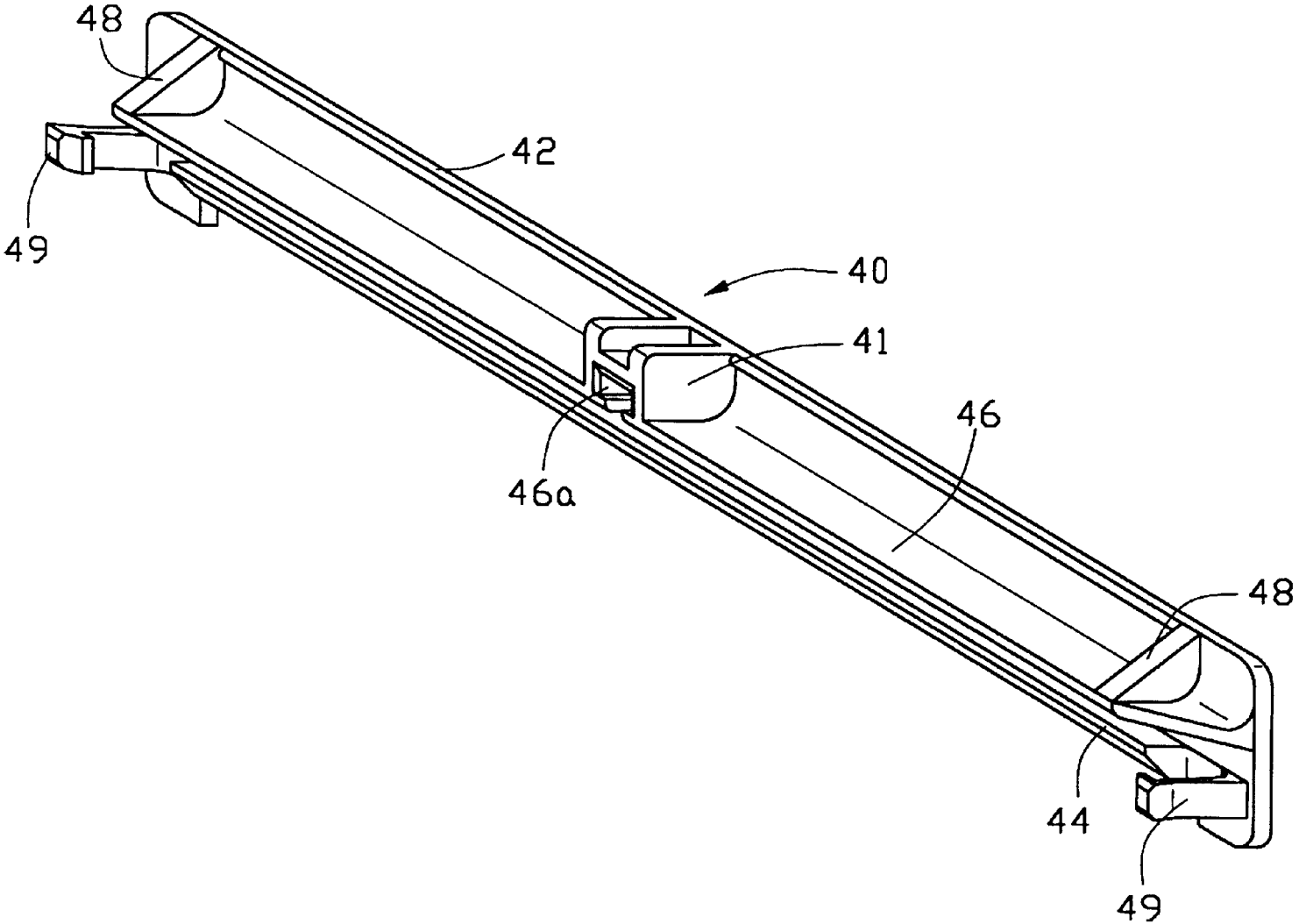
FIG. 2 is a perspective view of an actuator of the present invention, taken from an aspect different to that of FIG. 1.
Figure 3:
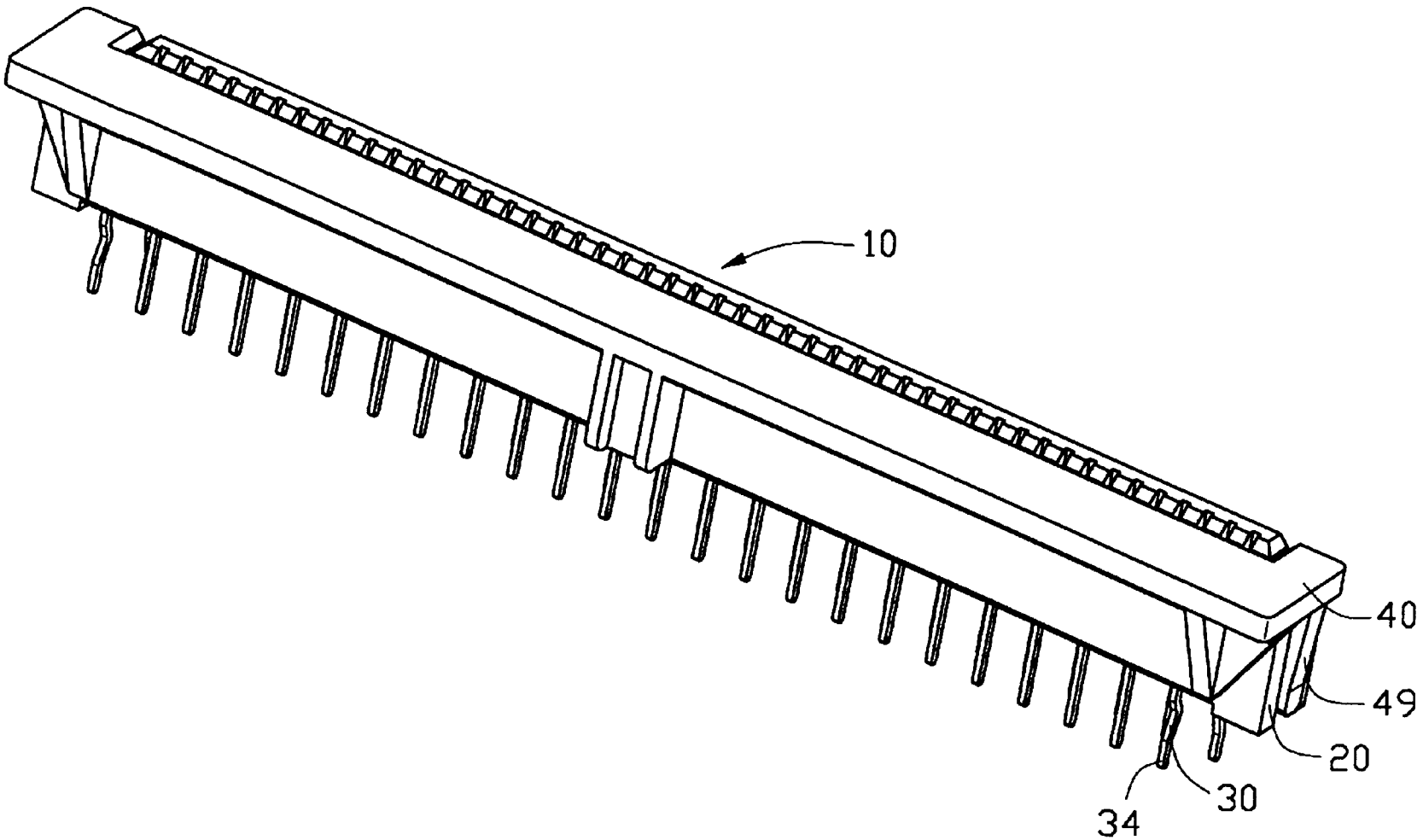
FIG. 3 is an assembled view of the connector of FIG. 1.
Figure 4:
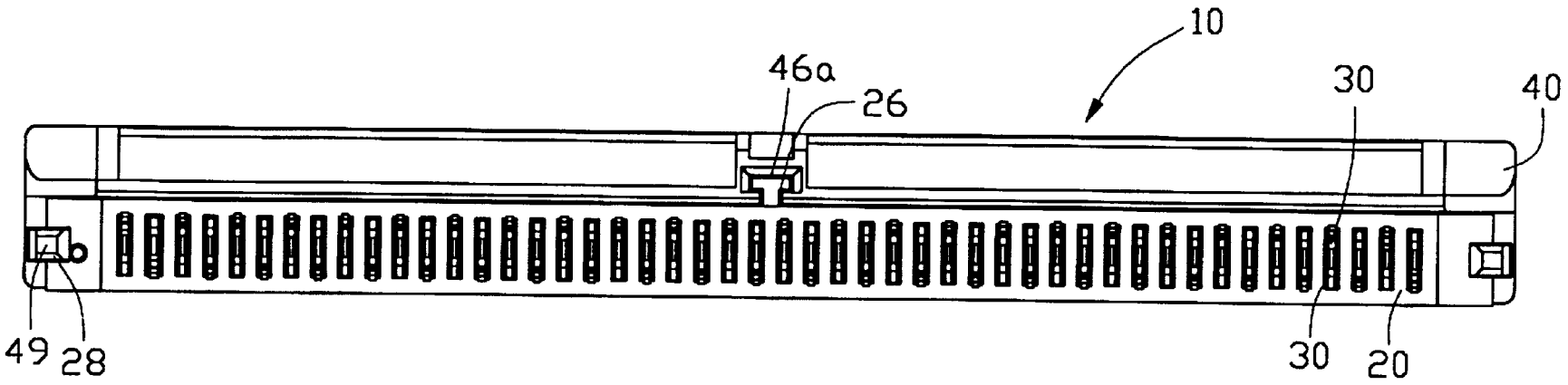
FIG. 4 is a bottom view of FIG. 3.
Figure 5:
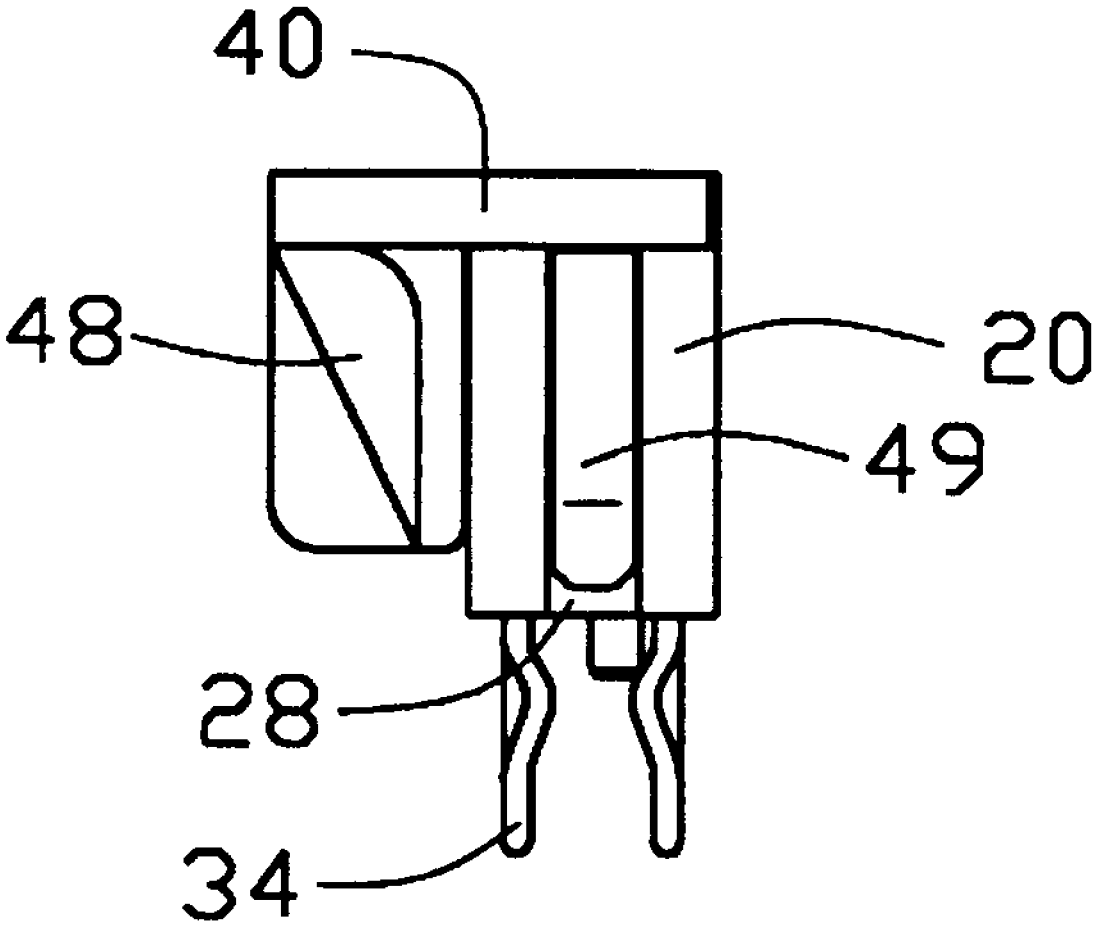
FIG. 5 is a right side view of FIG. 3.

Referring to FIGS. 1 to 4, an electrical connector 10 in accordance with the present invention comprises an elongate insulative housing 20, a plurality of terminals 30 secured within the insulative housing 20, and an actuator 40 adapted for firmly retaining a flexible printed circuit (FPC) which has been inserted into the insulative housing 20.

The insulative housing 20 comprises an elongate first wall 20*a* and an elongate second wall 20*b* parallel to the first wall 20*a*. A central slot 22 is defined between the first and the second walls 20*a* and 20*b* for insertion of a lower portion of the FPC 50 (see FIG. 6). The first wall 20*a* and the second wall 20*b* each define rows of receiving channels 24 along inner surfaces (not labeled) thereof. Each receiving channel 24 communicates with the central slot 22. Each pair of opposed receiving channels 24 cooperatively receives and retains a corresponding terminal 30. A T-shaped securing portion 26 extends perpendicularly from a middle portion of an outer surface (not labeled) of the first wall 20*a*. The insulative housing 20 defines a vertical securing recess 28 at each of two opposite ends thereof.

Each terminal 30 comprises a U-shaped contact portion 32 secured within a pair of opposed receiving channels 24, and a pair of solder tails protruding from a bottom surface (not labeled) of the housing 20. Each contact portion 32 partially protrudes into the central slot 22 for contacting with a corresponding conductive pad (not shown) of the FPC 50. The solder tails 34 are for soldering to a printed circuit board (not shown).

The actuator 40 is made of an insulative material and includes a base 42, an inserting beam 44 depending perpendicularly from the base 42, and a reinforcing beam 46 also depending perpendicularly from the base 42 and formed parallel to the inserting beam 44. A block 41 is formed at a central portion of the actuator 40, connected between the base 42 and the reinforcing beam 46. The reinforcing beam 46 and the block 41 together define a T-shaped securing channel 46*a* therebetween, for retaining the T-shaped securing portion 26 of the housing 20. A V-shaped rib is formed at each end of the actuator 40 between the base 42 and the reinforcing beam 46. A clip 49 is formed at each end of the actuator 40, for engaging with a corresponding securing recess 28 of the housing 20.

Figure 6:
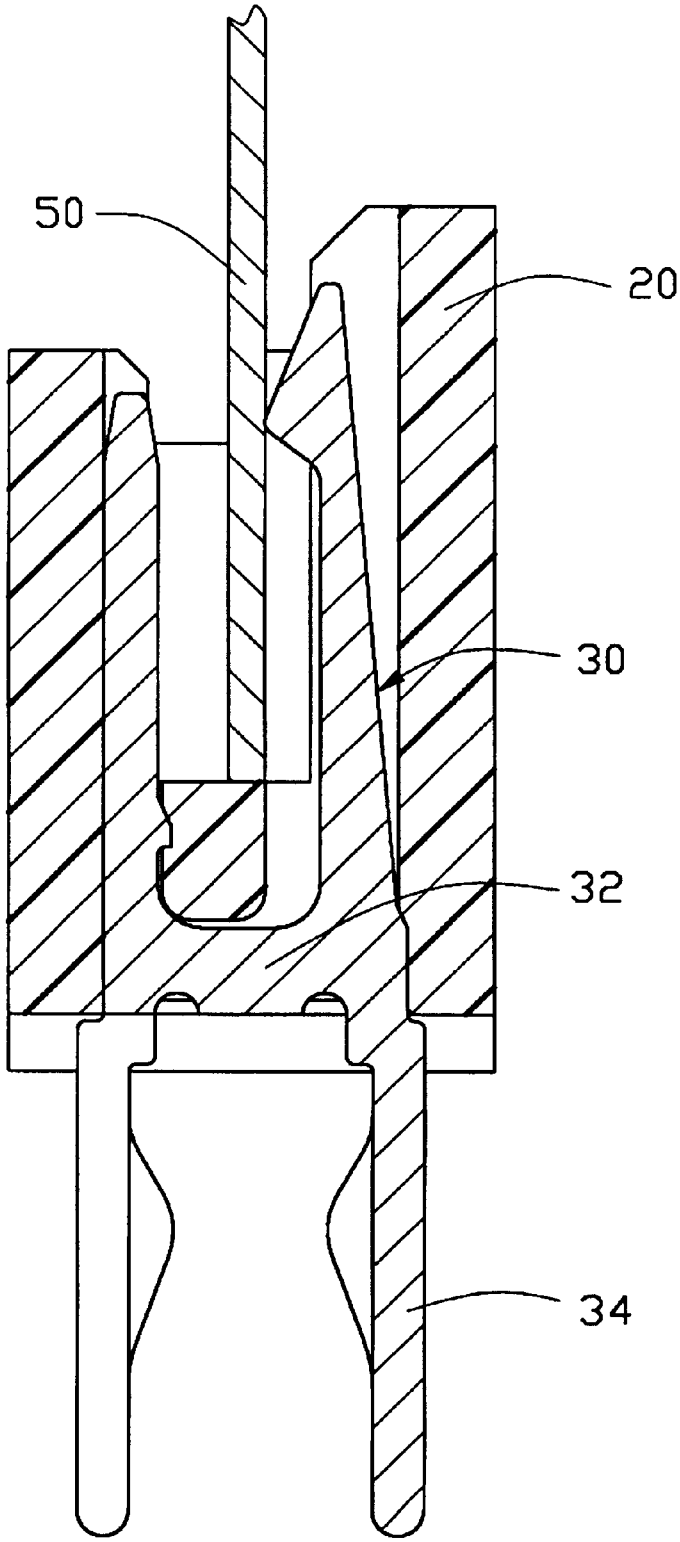
FIG. 6 is a cross-sectional view of the insulative housing with an FPC inserted thereinto.
Figure 7:
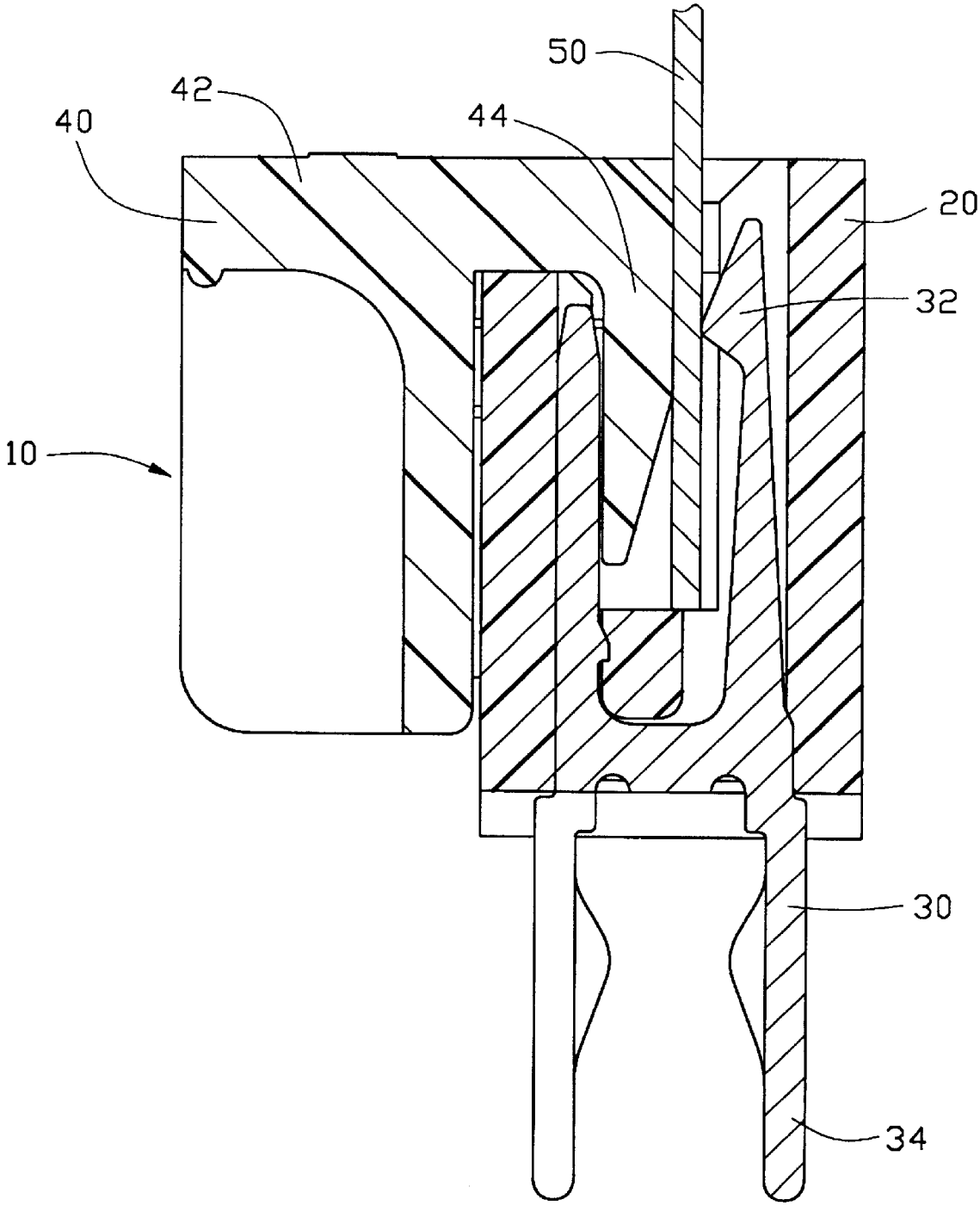
FIG. 7 is similar to FIG. 6, with the actuator of FIG. 1 inserted into the insulative housing.

Referring to FIGS. 1, 6 and 7, in assembly, the terminals 30 are secured within the insulative housing 20 such that the contact portions 32 protrude into the central slot 22. The FPC 50 is then inserted downwardly into the central slot 22 of the insulative housing 20. The inserting beam 44 of the actuator 40 is then uprightly inserted into the central slot 22 of the insulative housing 20, and the reinforcing beam 46 firmly abuts against the outer surface of the first wall 20*a*. At the same time, as the inserting beam 44 and the reinforcing beam 46 tightly clamp the first wall 20*a* therebetween, the T-shaped securing portion 26 of the insulative housing 20 is engagingly received within the T-shaped securing channel 46*a* of the actuator 40. The actuator 40 pushes the conductive pads (not shown) of the FPC 50 firmly against the terminals 30, thus ensuring good electrical contact therebetween. The clips 49 of the actuator 40 latch with the securing recesses 28 of the housing 20, locking the actuator 40 in place against the housing 20.

Advantages of the present invention include that the engagement between the T-shaped securing portion 26 and the T-shaped securing channel 46*a* provides mechanical stability to the actuator 40 during engagement between the actuator 10 and the housing 20, thereby minimizing warpage of the housing 20 and actuator 40 during engagement and separation of the housing 20 and the actuator 40.

Another advantage of the present invention is that the V-shaped ribs 48 mechanically reinforce the strength of the actuator 40, thereby minimizing warpage of the actuator 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector with an actuator adapted to facilitate connection of a flexible printed circuit (FPC) inserted into the electrical connector, comprising:

an elongate insulative housing defining a central slot therein for insertion of the FPC, and at least a securing portion formed on an outer surface of the housing;

a plurality of terminals secured within the central slot and partially protruding into the central slot, for contacting with the FPC; and an actuator comprising a base with an inserting beam and a reinforcing beam respectively depending from the base, the reinforcing beam forming at least a block on a surface thereof and the block defining a securing channel corresponding to the securing portion of the housing;

wherein after the FPC has been inserted into the central slot of the housing, the actuator is engaged with the housing such that the inserting beam urges the FPC to contact with the terminals, wherein the reinforcing beam engages with the securing portion of the housing, and wherein the inserting beam and the reinforcing beam are parallel to each other and connected to the base.

2. The electrical connector as claimed in claim 1, wherein the reinforcing beam and the block together define the securing channel.

3. The electrical connector as claimed in claim 1, wherein the actuator includes a plurality of V-shaped ribs formed between the base and the reinforcing beam.

4. The electrical connector as claimed in claim 1, wherein the housing defines at least a securing recess at each of two opposite ends thereof, and the actuator forms at least a clip at each of two opposite ends thereof for engaging with the corresponding securing recesses of the housing.

5. An electrical connector with an actuator adapted to facilitate connection of a flexible printed circuit (FPC) inserted into the electrical connector, comprising:

an elongate insulative housing defining a central slot therein for insertion of the FPC, and securing means formed on an outer surface of the housing, and a plurality of terminals secured within the central slot and partially protruding into the central slot, for contacting with the FPC; and an actuator comprising a base with an inserting beam and a reinforcing beam respectively depending from the base, the reinforcing beam having engaging means corresponding to the securing means of the housing, wherein the actuator is engaged with the housing such that the inserting beam urges the FPC to contact with the terminals of the housing and the engaging means engages with the securing means of the housing, and wherein the inserting beam and the reinforcing beam are parallel to each other and connected to the base.

6. The electrical connector as claimed in claim 5, wherein the securing means of the housing comprises at least a T-shaped securing portion, and the engaging means of the actuator comprises at least a block with at least a channel for engagement with the at least a securing portion of the housing.

7. The electrical connector as claimed in claim 6, wherein the reinforcing beam and the block together define the securing channel.

8. The electrical connector as claimed in claim 5, wherein the actuator includes a plurality of V-shaped ribs formed between the base and the reinforcing beam.

9. The electrical connector as claimed in claim 5, wherein the housing defines at least a securing recess at each of two opposite ends thereof, and the actuator forms at least a clip at each of two opposite ends thereof for engaging with the corresponding securing recesses of the housing.

10. An electrical connector assembly comprising:

an elongated insulative housing defining a central slot;

a plurality of terminals received within the central slot; and an actuator comprising an elongated base with an inserting beam and a reinforcement beam mutually spatially and respectively depending therefrom; wherein the inserting beam is inserted into the central slot while the reinforcement beam abuts against an outer surface of the housing; and wherein the inserting beam and the reinforcement beam are parallel to each other and connected to the base.

11. The connector as claimed in claim 10, wherein said inserting beam pushes the corresponding terminals away from both the inserting beam and the reinforcement beam.

12. The connector as claimed in claim 10, further including means for providing mechanical stability to the actuator during engagement between the actuator and the housing, thus minimizing warpage of the actuator.

13. The connector as claimed in claim 12, wherein said means includes a securing portion and a securing channels respectively disposed on the outer surface of the housing and the reinforcement beam of the actuator.

* * * * *